US007210557B2

(12) United States Patent
Phillips et al.

(10) Patent No.: US 7,210,557 B2
(45) Date of Patent: May 1, 2007

(54) LOW PROFILE ACOUSTIC FLOORING

(75) Inventors: John A. Phillips, Austin, TX (US); Robert W. Hayes, Austin, TX (US)

(73) Assignee: ETS-Lindgren, L.P., Cedar Park, TX (US)

( * ) Notice: Subject to any disclaimer, the term of this patent is extended or adjusted under 35 U.S.C. 154(b) by 448 days.

(21) Appl. No.: 10/818,933

(22) Filed: Apr. 6, 2004

(65) Prior Publication Data

US 2005/0217928 A1 Oct. 6, 2005

(51) Int. Cl.

| | |
|---|---|
| ***F16F 15/02*** | (2006.01) |
| ***F16F 7/00*** | (2006.01) |
| ***E04G 1/22*** | (2006.01) |
| ***F16M 11/32*** | (2006.01) |
| *E04B 5/00* | (2006.01) |
| *F16M 11/24* | (2006.01) |

(52) U.S. Cl. ..... 181/207; 52/263; 52/126.1; 52/126.6; 248/188.2

(58) Field of Classification Search ..... 181/207, 181/209, 285; 52/263, 126.1, 126.5, 126.7; 248/188.2, 188.4, 188.5, 354.3, 354.4
See application file for complete search history.

(56) References Cited

U.S. PATENT DOCUMENTS

| | | | | |
|---|---|---|---|---|
| 3,470,663 | A * | 10/1969 | Tate | 52/126.6 |
| 3,511,001 | A * | 5/1970 | Morgan, Jr. | 52/126.5 |
| 3,789,557 | A * | 2/1974 | Harvey | 52/126.6 |
| 4,258,516 | A * | 3/1981 | Mori et al. | 52/126.6 |
| 4,348,841 | A * | 9/1982 | Ueno et al. | 52/126.5 |
| 4,438,610 | A * | 3/1984 | Fifer | 52/263 |
| 4,449,876 | A * | 5/1984 | Glanton | 410/151 |
| 4,633,626 | A * | 1/1987 | Freeman et al. | 52/71 |
| 5,052,156 | A * | 10/1991 | Tanaka et al. | 52/126.6 |
| 5,072,557 | A * | 12/1991 | Naka et al. | 52/126.6 |
| 5,245,805 | A * | 9/1993 | Takeda et al. | 52/126.6 |
| 5,333,423 | A * | 8/1994 | Propst | 52/126.6 |
| 5,459,968 | A * | 10/1995 | Jin | 52/126.6 |
| 5,501,754 | A * | 3/1996 | Hiraguri | 156/71 |
| 5,628,157 | A * | 5/1997 | Chen | 52/263 |
| 5,872,340 | A * | 2/1999 | Anagnos et al. | 181/199 |
| 6,138,979 | A * | 10/2000 | Morman | 248/638 |
| 6,581,724 | B2 * | 6/2003 | Dutton et al. | 181/285 |
| 6,983,570 | B2 * | 1/2006 | Mead | 52/263 |
| 2002/0144477 | A1 * | 10/2002 | Chen | 52/263 |

(Continued)

FOREIGN PATENT DOCUMENTS

JP 03087460 A * 4/1991

(Continued)

OTHER PUBLICATIONS

Series 400 Molded Neoprene Pads and Typical Applications; http://www.acemount.com/MainPages/series400.htm and http://www.acemount.com/MainPages/400padtypicalapplications.htm.*

(Continued)

*Primary Examiner*—Edgardo San Martin
(74) *Attorney, Agent, or Firm*—Patrick Stellitano

(57) ABSTRACT

An isolator is partially but substantially recessed in an acoustic floor and a leveling mechanism at least partially recessed in the acoustic floor is connected to the acoustic isolator to adjust the height of the acoustic floor when the floor is in place.

16 Claims, 6 Drawing Sheets

U.S. PATENT DOCUMENTS

| | | | | |
|---|---|---|---|---|
| 2004/0154240 | A1* | 8/2004 | Hiraguri et al. | 52/144 |
| 2005/0050818 | A1* | 3/2005 | Chen et al. | 52/263 |

FOREIGN PATENT DOCUMENTS

| | | | | |
|---|---|---|---|---|
| JP | 03290559 | A | * | 12/1991 |
| JP | 03295969 | A | * | 12/1991 |
| JP | 05005353 | A | * | 1/1993 |
| JP | 05141073 | A | * | 6/1993 |
| JP | 05280181 | A | * | 10/1993 |
| JP | 06167096 | A | * | 6/1994 |
| JP | 06307062 | A | * | 11/1994 |
| JP | 06322953 | A | * | 11/1994 |

OTHER PUBLICATIONS

Series E Stock & Custom Molded Rubber Products; http://www.acemount.com/MainPages/seriese.htm.*

Series 250 Leveling Mounts; http://www.acemount.com/MainPages/series250.htm.*

McMaster-Carr Catalog, pp. 1246, 2994 and 3042; Leveling Mounts, Hex Head Cap Screws and Acorn Nuts & Tamper-Resistant Nuts.*

* cited by examiner

LOW PROFILE ACOUSTIC FLOORING

TECHNICAL FIELD OF THE INVENTION

The present invention relates to acoustics and methods of sound-proofing rooms, and more particularly to methods of mounting an acoustic structure such as an acoustic enclosure upon a host surface such as a floor of a room enclosing the acoustic structure.

BACKGROUND OF THE INVENTION

In the field of acoustics, one often desires to place an acoustic structure upon a host surface such as the floor of a host building enclosing the acoustic structure. For example, an acoustic enclosure such as a sound-proof room is placed on a floor inside a building. Such acoustic enclosures include those described in U.S. Pat. No. 6,581,724 issued to Acoustic Systems, Inc., a division of ETS Lindgren, L. P., the assignee of the present invention.

In many applications one desires to prevent sound waves from being transmitted between the host surface and the acoustic enclosure. For this reason, the acoustic structure is mounted upon the surface using a sound absorbing mechanism. An expanded view of an assembly for mounting an acoustic enclosure upon a floor of a host building is shown in FIG. 1. Resting upon the host floor 100 are isolators 120 and 130. Each isolator assembly is formed from an upper conventional C-channel 150 and a lower conventional C-channel 160. Between these two channels is a sound absorber 140, which absorbs vibrations between the floor 100 and upper channel 150. Absorber 140 substantially prevents transmission of sound between host floor 100 and an acoustic floor 1000. Absorber 140 may be made of elastomer or other known material. Resting upon isolators 120 and 130 is acoustic floor 1000 formed by a lower floor plate 170 and an upper floor plate 180 supported by vertical supports 190. In the region between the upper and lower plates is placed sound absorbing material to form the acoustic floor.

Acoustic floor 1000 is of a height X and isolators 120 and 130 are of a height Y. The total height of the step from the host floor 100 to the top of the acoustic floor 1000 is X+Y. This reduces the space between the acoustic floor and the interior ceiling of the acoustic enclosure, the height of the interior ceiling being limited by the height of the ceiling of the host room within which the acoustic enclosure is located.

Further, when a ramp is required, for example, to comply with the Americans with Disabilities Act, or to roll equipment into and out of the acoustic enclosure, the height of the step, X+Y, dictates the length of the ramp. For example, the length of the ramp may be required to be not less than X+Y inches times one foot per inch. Thus, if the height of the step is 7.5 inches, the ramp must be 7.5 feet long!

Moreover, in some instances, there must be no step at all. That is, the floor of the acoustic enclosure must be level with a host floor, as indicated by the raised floor section 111. This results in considerable difficulty installing the acoustic floor because the acoustic floor must be leveled. If not level, the acoustic floor must be removed so that shims can be placed under the isolators to level the floor. As can be imagined, this can be a laborious, time-consuming task.

For at least these reasons, there is a need for a method for mounting an acoustic structure upon a host surface that reduces the step height of the floor of the acoustic structure and enables easy leveling of the floor of the structure.

SUMMARY OF THE INVENTION

The present invention provides a method for mounting an acoustic structure upon a host surface that reduces the step height of an acoustic floor and enables easy leveling of the acoustic floor. According to the present invention, an acoustic isolator is partially but substantially recessed within the acoustic floor so that only a bottommost portion of the isolator extends below the acoustic floor to make contact with the host floor. Because the acoustic isolator is recessed substantially within the acoustic floor, the step size is substantially reduced. Thus, the isolator provides acoustic isolation between the host floor and the acoustic floor without substantially increasing the height of the acoustic floor above the host floor.

According to another aspect of the invention, a leveling mechanism is provided that enables leveling of the floor from above with the floor in place. The leveling mechanism is also substantially or totally recessed within the body of the acoustic floor. Access is provided to the leveling mechanism from above to enable in-place leveling of the acoustic floor. In this way leveling adjustments can be made without removing the floor or any part thereof.

The foregoing has outlined rather broadly aspects, features and technical advantages of the present invention in order that the detailed description of the invention that follows may be better understood. Additional aspects, features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
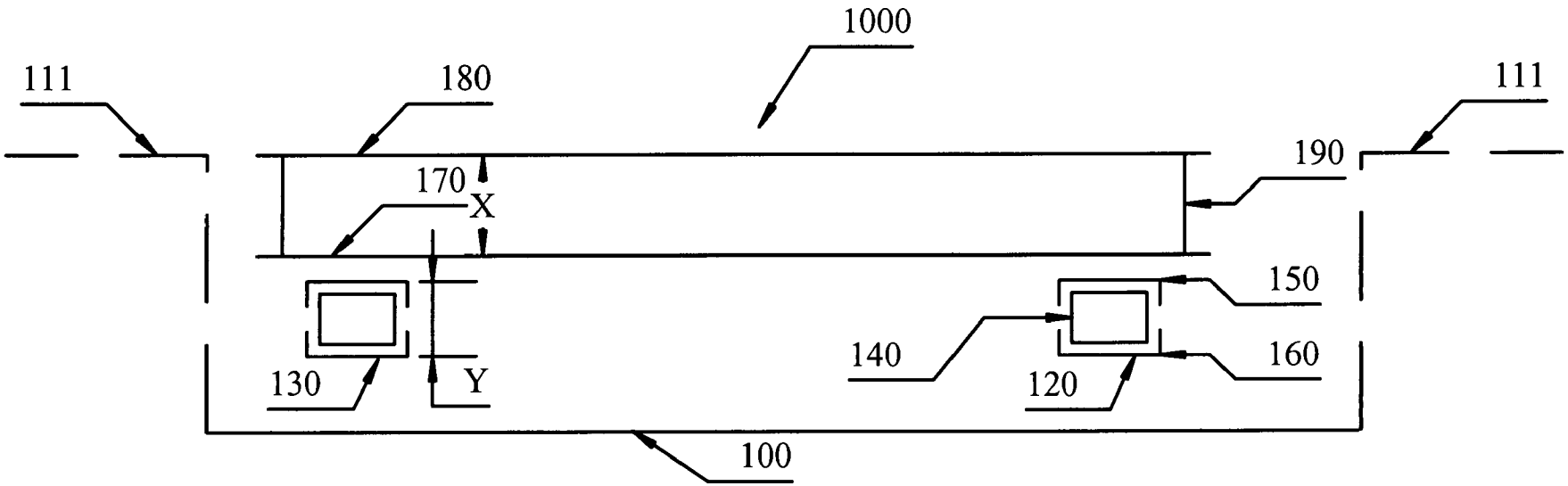
PRIOR ART Fig. 1
FIG. 1 is an expanded view of a prior art method of mounting an acoustic floor upon a host surface.
Figure 2:
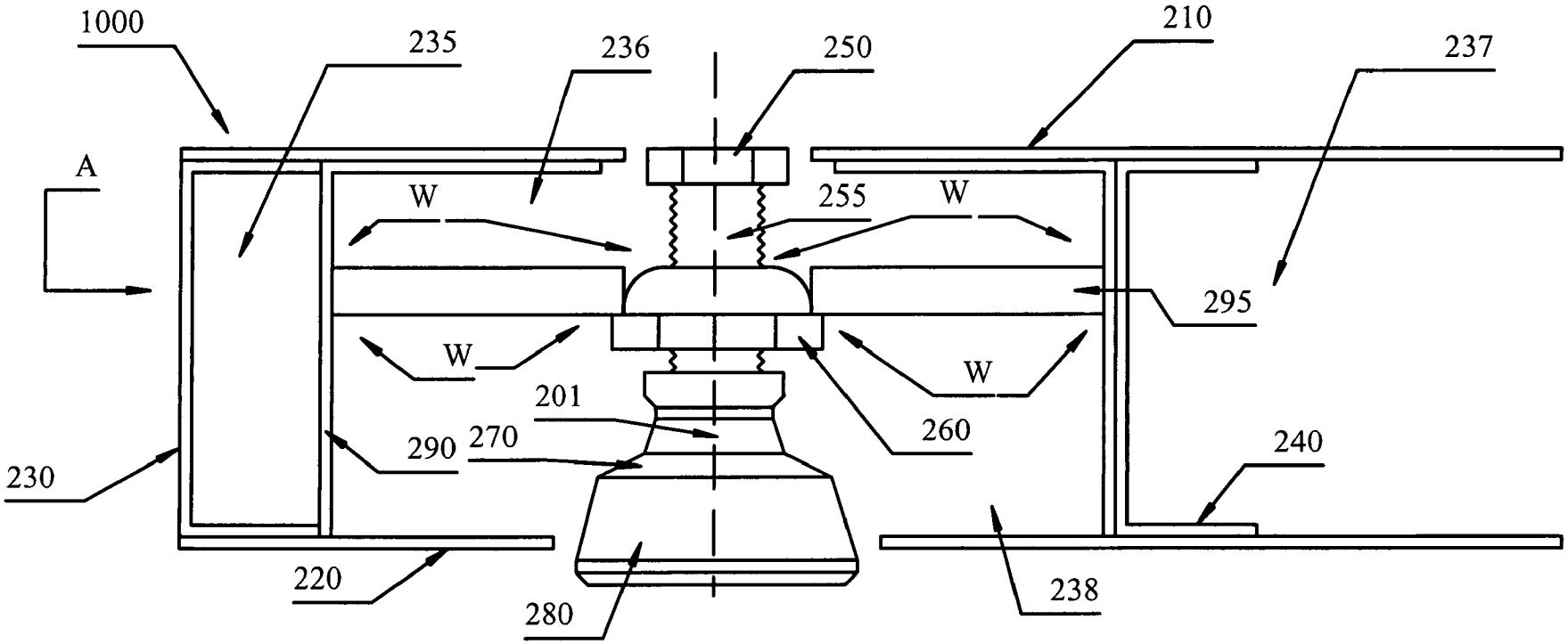
FIG. 2 is an embodiment of an inventive isolator and leveling mechanism, installed near an end of an acoustic floor according to the method of the present invention.

FIG. 2 illustrates an embodiment of an inventive isolator installed near an end of an acoustic floor according to the method of the present invention. Acoustic floor 1000 comprises an upper steel plate 210 and a lower steel plate 220. A C-channel 230 made of nominally 11-gauge steel is at an end of acoustic floor 1000. Another similar C-channel 240 is placed inward from the end of acoustic floor 1000 a distance sufficient to accommodate the isolator assembly to be herein described.

The isolator assembly includes a bolt 250 with a threaded section 255 that is threaded through an acorn nut 260 and into a swivel leveling mount 270 which swivels about a point 201. A swivel leveling mount with a 5000 lb load rating may be obtained from McMaster Carr, part number 6103k22. See www.mcmaster.com. A bolt that will fit this part is part number 92240a723. An acorn or dome nut that this bolt will thread through is part number 94301a160.

Attached to, or integrated into, swivel leveling mount 270 is an isolator puck 280 made of a hard but compressible elastomer or other strong compressible material. Isolator puck 280 may be attached to swivel leveling mount 270 with screws. A clearance such as a circular hole is provided in lower plate 220 to enable the bottommost end of isolator puck 280 to project below the acoustic floor. Isolator puck 280 absorbs sound waves that might otherwise transmit between the host floor and the acoustic floor. Further, acoustic absorbing material is preferably placed in regions 235, 236, 237 and 238 to absorb sound.

The arrows marked W in FIG. 2 point to regions where parts are welded to form the isolator. Acorn nut 260 is welded to a steel plate 295 with a circular hole for bolt 250 to pass there through. Steel plate 295 is welded to a C-channel 290, so that bolt 250 is free to turn while acorn nut 260 is held fixed. Bolt 250 is threaded into and terminates at its lower end in swivel leveling mount 270. In this way the height of the acoustic floor in the vicinity of the isolator is adjustable, for as bolt 250 is turned the height of the acoustic floor changes. Access to turn bolt 250 is provided by cutting or drilling a circular hole in upper plate 210 and in C-channel 290 sufficient to insert a tool over the head of the bolt to apply torque.

Because the isolator of the present invention is substantially recessed in the acoustic floor 1000, the step size of the acoustic flooring, that is, the height from the host surface upon which the isolator rests to the top of the acoustic floor, is substantially reduced.

Figure 3:
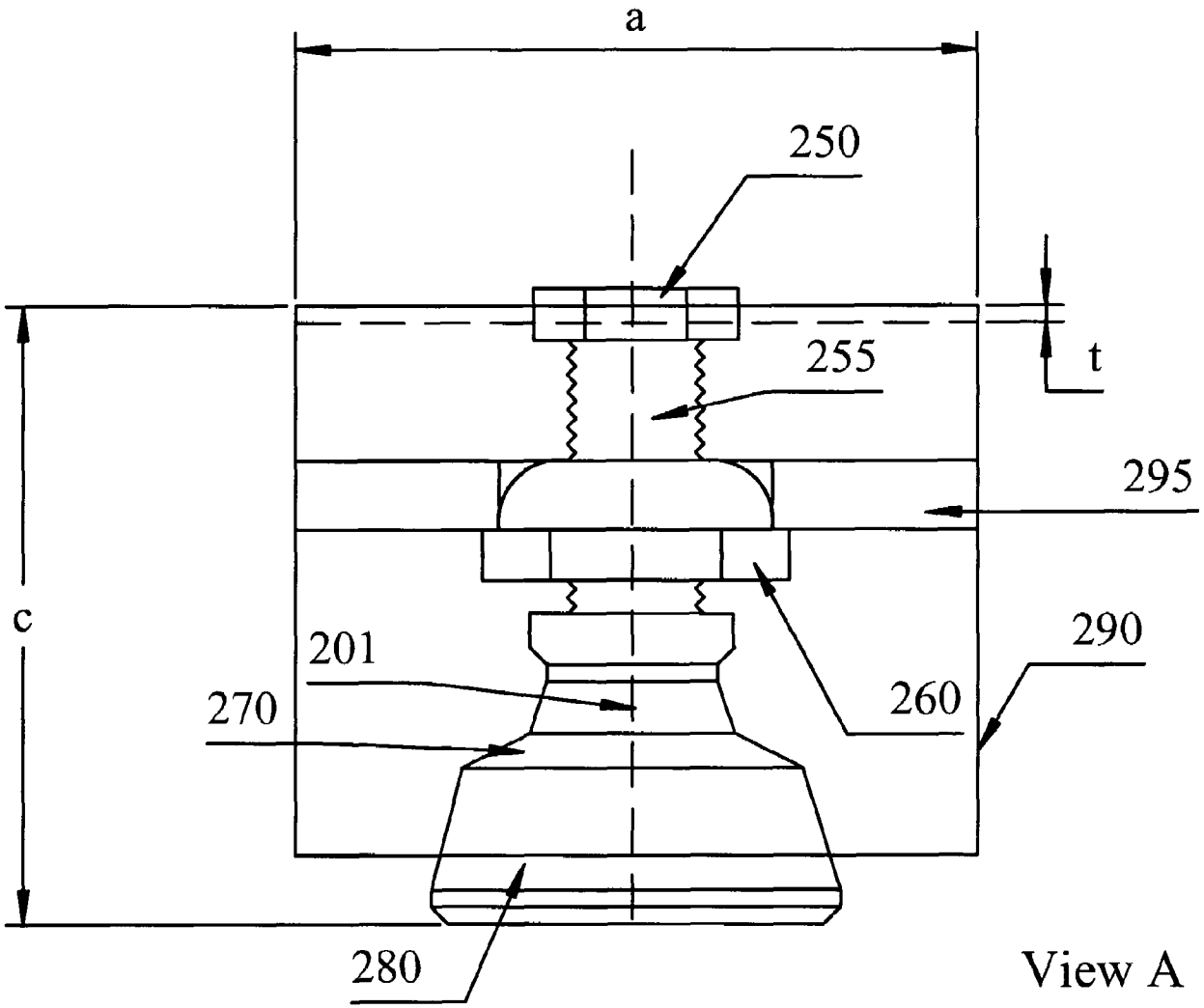
FIG. 3 is an end view of an embodiment of the present invention.

FIG. 3 shows an end cross-sectional view, A, of the low-profile acoustic isolator and leveling mechanism of the present invention. C-channel 290 may be made of 11 gauge steel of thickness, t, and cut to a width, a. As bolt 250 is turned clockwise, threaded section 255 threads downward through acorn nut 260, thereby lifting the acoustic floor as the height, c, increases. As bolt 250 is turned counterclockwise, threaded section 255 threads upward through acorn nut 260, thereby lowering the acoustic floor, as the height, c, decreases. Thus, the present invention provides a leveling mechanism substantially recessed within the acoustic floor and connected to an acoustic isolator, also substantially recessed within the acoustic floor, and moveably connected to the acoustic floor so that when the leveling mechanism is adjusted, the floor moves vertically with respect to the position of the isolator.

Note that the bolt 250 can be adjusted so that when the floor is leveled, the bolt head remains recessed within or flush with the top panel 210 of acoustic floor 1000. This avoids protrusion of bolt 250 above the acoustic floor surface.

Figure 4:
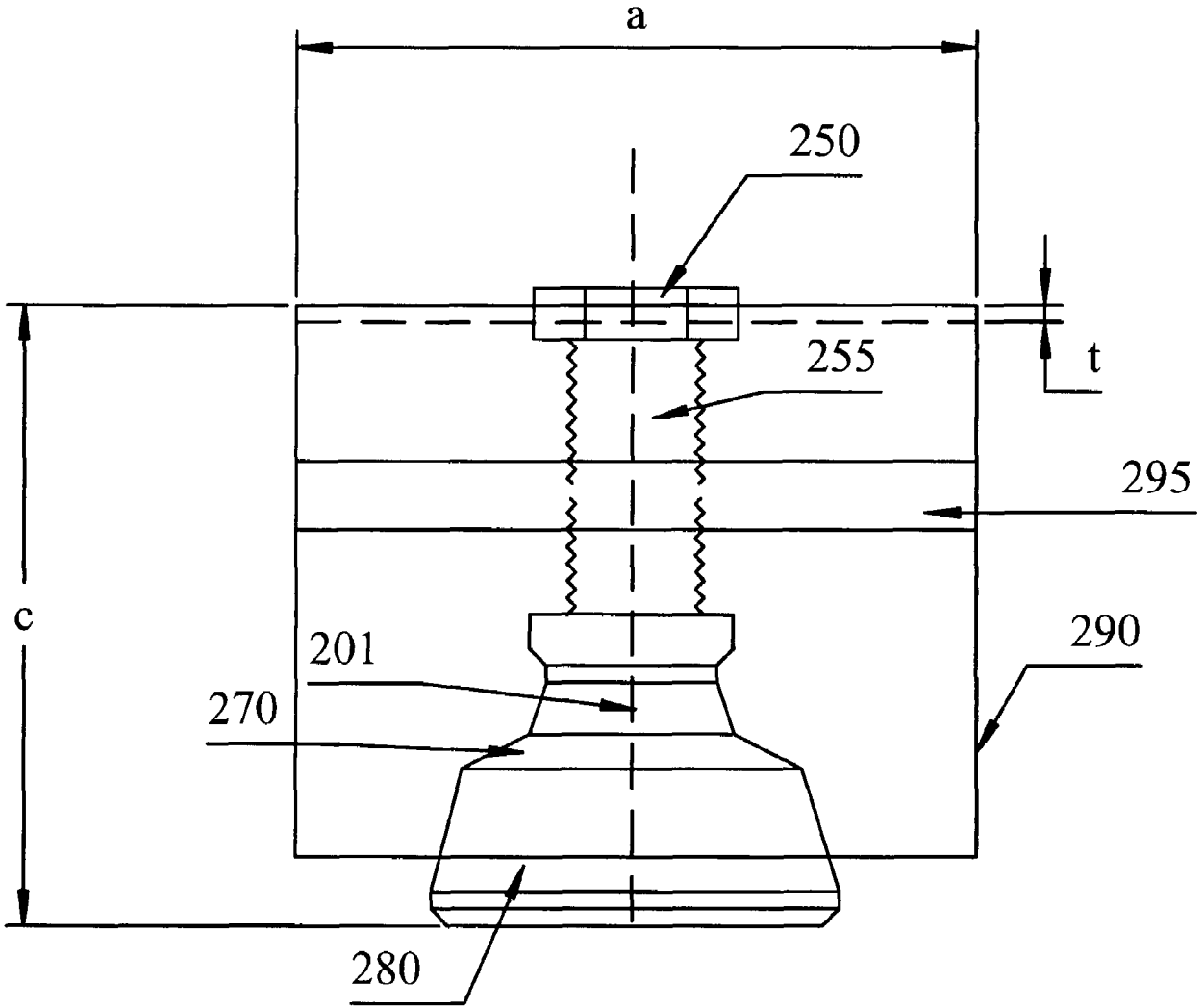
FIG. 4 is an end view of an alternative embodiment of the present invention.

FIG. 4 shows an end view of a simpler embodiment wherein steel plate 295 is itself threaded to receive threaded section 255 of bolt 250, thus eliminating the acorn nut 260 from the structure. This embodiment may be less preferable since plate 295 would have to be very hard steel to withstand the load placed on the acoustic floor. A milder steel can be used in the preferred embodiment depicted in FIG. 3 because the hard steel bolt is welded to plate 295 and thereby substantially distributes the load.

Figure 5:
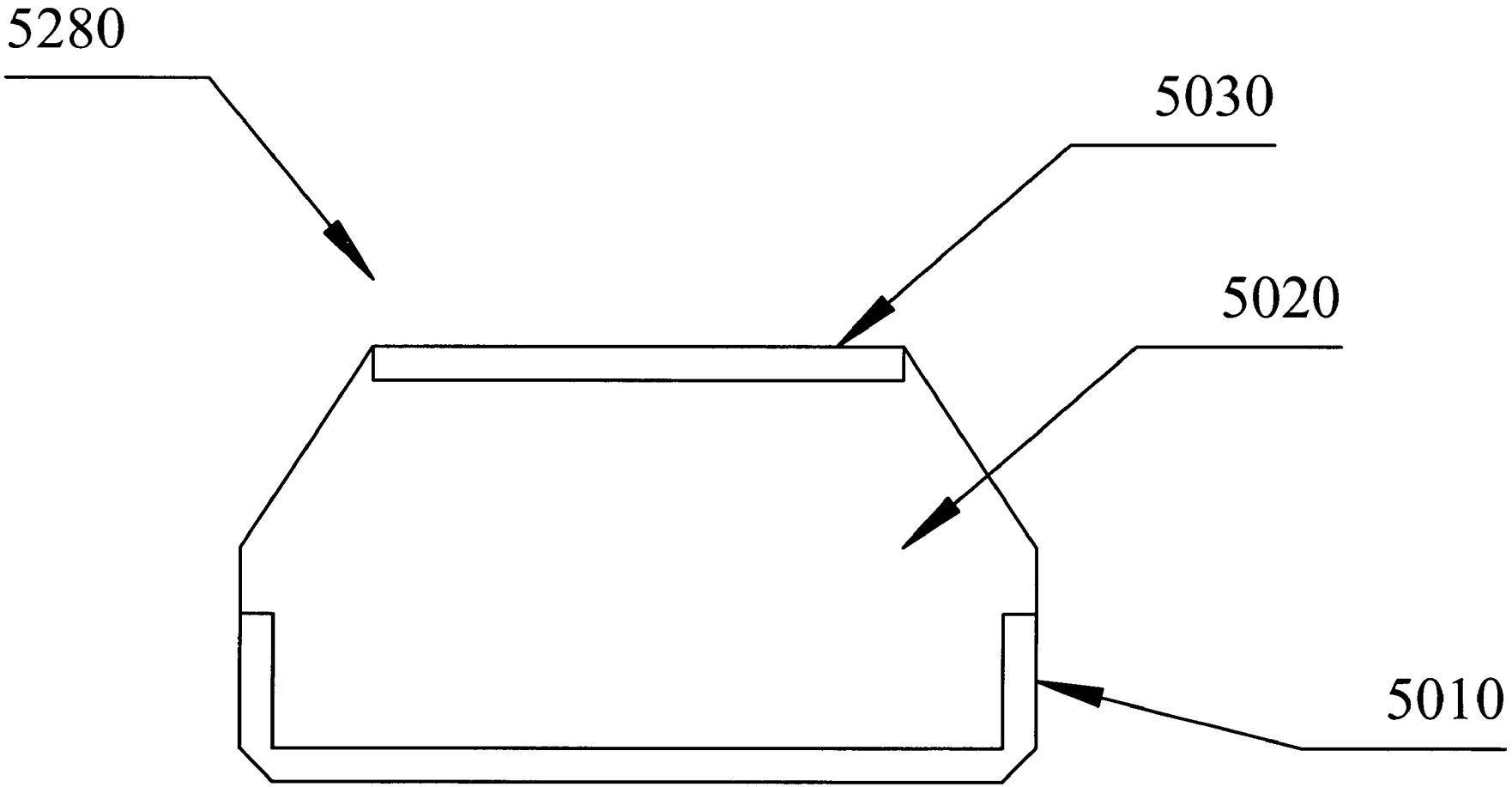
FIG. 5 is a diagram of an isolator puck.

FIG. 5 shows an embodiment of an isolator puck 5280 formed of a sound absorbing elastomeric material 5020 with a steel cup 5010 on the bottom and a steel washer 5030 on top. This part may be obtained from Ace Mountings Co., Inc. http://www.acemount.com/. Swivel leveling mount 270 may be screwed to puck 5280.

A plurality of acoustic isolators as just described can be distributed uniformly to provide adequate support for the anticipated load on the acoustic floor. Further, once the floor is in place, the entire floor may be quite accurately leveled in place by adjusting each leveling bolt as needed. The ability to level the floor in-place is a substantial advantage, especially when the top of the acoustic floor must be level with a raised floor.

Figure 6:
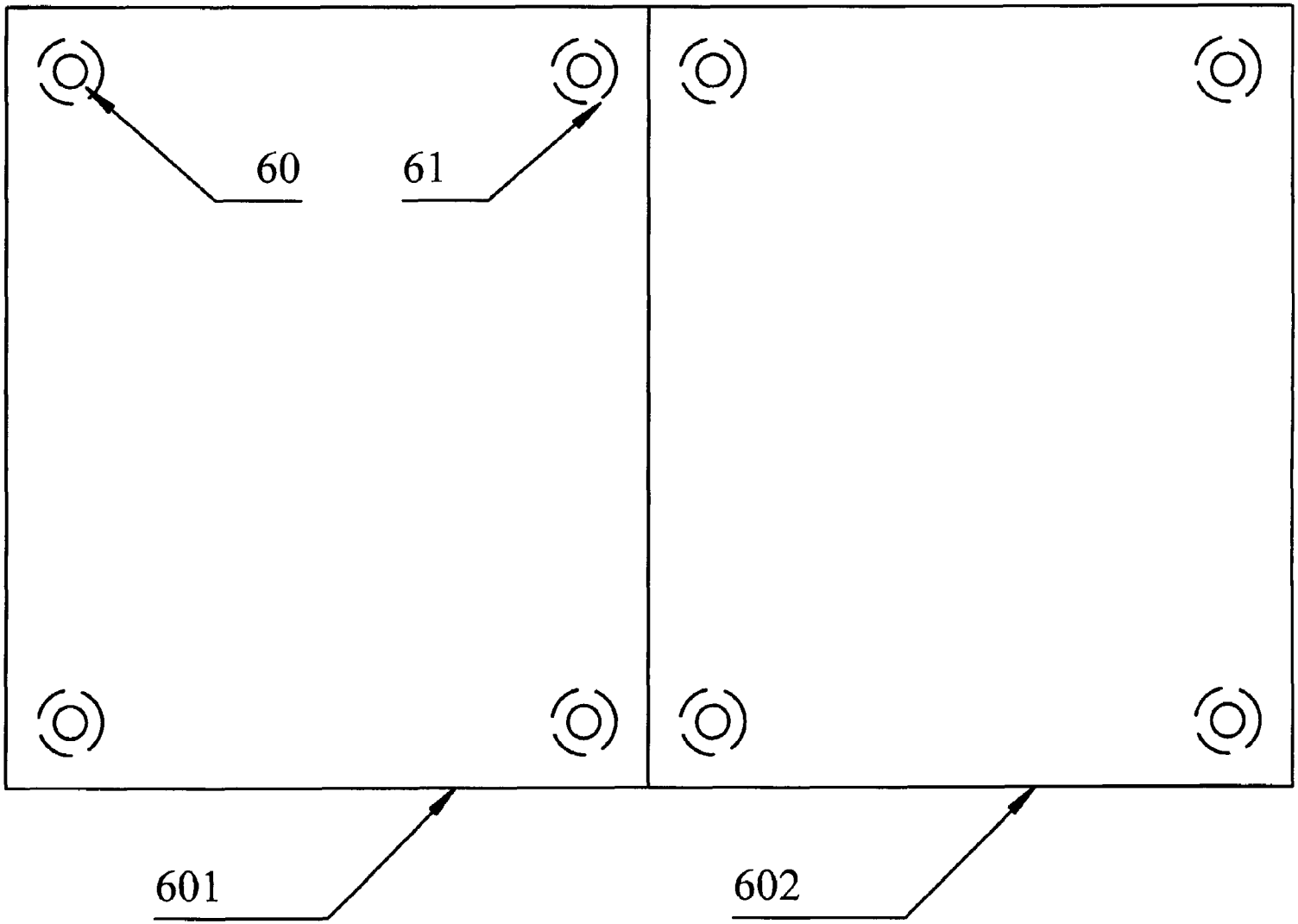
FIG. 6 is a diagram of a plurality of acoustic floor panels installed with isolators of the present invention.

FIG. 6 shows a top view of two acoustic floor panels 601 and 602 joined at an edge. Each floor panel comprises acoustic isolators, one on each corner of the panel. An access cutout 60 for each isolator enables access to bolts 250 to level the floor from above. The outer circle 61 shows the circumference of a cutout in the bottom panel of the acoustic floor to allow the isolator puck 280 to contact the host floor. In the configuration shown in FIG. 6, each panel can be separately adjusted in height and leveled without removing a floor panel. Obviously, multiple acoustic floor panels can be installed this way. Note that a flexible removable dust cap can be inserted to cover each cutout 60, to cover the holes in the upper surface of each acoustic floor panel. The cap can be removed to adjust the leveling mechanism and then replaced.

Thus, the present invention provides a method for constructing an acoustic enclosure with acoustically isolated adjustable flooring. Although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A low-profile load-bearing acoustic floor isolator method, comprising:

providing at least one acoustic isolator to provide acoustic isolation between the acoustic floor and a base floor above which the acoustic floor is supported;

mostly recessing the acoustic isolator within the acoustic floor; and wherein the acoustic isolator comprises a first nut moveably threaded on a threaded shaft, the first nut immovably affixed to the acoustic floor, and with a second nut immovably affixed to the threaded shaft so that torque applied to the second nut causes the shaft to move vertically with respect to the first nut and the acoustic floor, and wherein at a base of the threaded shaft is an acoustic isolating puck in contact with the base floor to provide acoustic isolation.

2. The method of claim 1, wherein the first nut of the acoustic isolator is immovably affixed to a horizontal plate immovably affixed to the floor.

3. The method of claim 1, wherein the second nut of the acoustic isolator is accessible from above the acoustic floor when the acoustic floor is in place to enable the acoustic floor to be raised or lowered when the acoustic floor is in place.

4. The method of claim 1, wherein a plurality of acoustic isolators are distributed to allow leveling of the floor by adjustment at multiple places.

5. The method of claim 1, wherein the threaded shaft swivels with respect to the acoustic isolating puck.

6. A low-profile load-bearing acoustic floor isolation and leveling apparatus, comprising:

an acoustic isolator mostly recessed within the acoustic floor, the isolator comprising a threaded shaft coupled to an acoustic isolating puck;

a threaded portion immovably a part of the acoustic floor with the threaded shaft movably threaded through the threaded portion; and a nut immovably a part of the threaded shaft, so that torque applied to the nut turns the threaded shaft and moves the threaded portion and acoustic floor vertically with respect to a base floor upon which the acoustic isolating puck rests.

7. The apparatus of claim 6, wherein the threaded portion is a horizontal plate.

8. The apparatus of claim 6, wherein the threaded portion is a nut welded to a horizontal plate.

9. The apparatus of claim 6, wherein the nut is accessible from above the acoustic floor when the acoustic floor is in place to enable the acoustic floor to be raised or lowered when the acoustic floor is in place.

10. The apparatus of claim 6, wherein a plurality of isolators are distributed to allow leveling of the acoustic floor by adjustment at multiple places.

11. The apparatus of claim 6, wherein the threaded shaft swivels with respect to the acoustic isolating puck.

12. An acoustic enclosure with acoustically isolated adjustable load-bearing flooring, comprising:

acoustic flooring for the acoustic enclosure, the flooring having a threaded portion immovably a part of the acoustic flooring;

a threaded shaft movably threaded through the threaded portion and connected to an acoustic isolating part that rests upon a base floor supporting the acoustic enclosure; and a nut immovably a part of the threaded shaft, so that when torque is applied to the nut, the threaded shaft and acoustic isolating part move vertically with respect to the acoustic flooring and threaded portion thereof; and wherein the threaded shaft, nut and acoustic isolating part are mostly recessed in the acoustic flooring above the base floor.

13. The enclosure of claim 12, wherein the threaded shaft is swivel-connected to the isolating part.

14. The enclosure of claim 12, wherein the threaded portion is a horizontal plate.

15. The enclosure of claim 12, wherein the threaded portion is a nut welded to a horizontal plate.

16. The enclosure of claim 12, wherein the nut is accessible from above the acoustic floor when the acoustic floor is in place to enable the acoustic floor to be raised or lowered when the acoustic floor is in place.

* * * * *